United States Patent [19]

Ilvespää

[11] Patent Number: 4,972,608

[45] Date of Patent: Nov. 27, 1990

[54] MULTI-CYLINDER DRYER FOR A PAPER MACHINE WITH SUPPORTED DRAW OF WEB

[75] Inventor: Heikki Ilvespää, Jyväskylä , Finland

[73] Assignee: Valmet Paper Machinery Inc., Finland

[21] Appl. No.: 426,185

[22] Filed: Oct. 25, 1989

[30] Foreign Application Priority Data

Feb. 17, 1989 [FI] Finland ..... 890786

[51] Int. Cl.[5] ..... F26B 11/02

[52] U.S. Cl. ..... 34/115; 34/116; 34/117

[58] Field of Search ..... 34/115, 116, 117

[56] References Cited

U.S. PATENT DOCUMENTS

| | | | |
|---|---|---|---|
| 3,355,816 | 12/1967 | McKie et al. | 34/116 |
| 3,753,298 | 8/1973 | Ely | 34/117 |
| 4,510,698 | 4/1985 | Ely | 34/116 |
| 4,669,198 | 6/1987 | Wedel | 34/116 |
| 4,875,976 | 10/1989 | Wedel | 34/117 |

FOREIGN PATENT DOCUMENTS

WO88/04206 6/1988 PCT Int'l Appl. .

*Primary Examiner*—Henry C. Yuen

*Attorney, Agent, or Firm*—Steinberg & Raskin

[57] ABSTRACT

A multi-cylinder dryer for a paper machine having several drying groups situated one after the other, in which drying cylinders are situated one above the other in stacks, preferably in vertical stacks. In subsequent groups, a web is passed from one drying cylinder onto a next drying cylinder by way of a single-wire draw, so that the drying cylinders in the single-wire draw groups are situated outside the loops of their respective drying a wires. The web is passed as a supported draw from one single-wire group to a subsequent single-wire group by using at least two transfer-suction rolls. A first one of the transfer-suction rolls is situated inside a loop of a drying wire of the preceding single-wire draw group. The second or final transfer-suction roll is situated proximate to the first suction roll and inside a loop of a drying wire of the latter or subsequent single-wire draw group, proximate to a first drying cylinder in this subsequent group. Transfer of the web from one wire group to the next wire group takes place with support by a drying wire substantially all the time. At that location, the web is subjected to a difference in pressure that maintains the web in contact with a drying wire, generally a negative pressure being effective from the drying-wire side.

5 Claims, 2 Drawing Sheets

MULTI-CYLINDER DRYER FOR A PAPER MACHINE WITH SUPPORTED DRAW OF WEB

BACKGROUND OF THE INVENTION

The present invention concerns a multi-cylinder dryer for a paper machine, comprising several drying groups situated one after the other, in which drying cylinders are placed one above the other in stacks, preferably in vertical stacks. In at least two subsequent groups, the webs pass from one drying cylinder onto the next drying cylinder by means of a single-wire draw, so that the drying cylinders in the single-wire draw groups are situated outside the loops of their respective drying wires when the web is passed from one cylinder onto the next cylinder over suction rolls while supported by the wire, and onto the drying cylinders of the single-wire groups so that the web enters into direct contact with the heated face of the drying cylinder while pressed by the drying wire over a considerably large sector, most appropriately larger than 180°.

As a rule, the prior-art multi-cylinder dryers for paper machines comprise two lines of steam-heated, large-diameter drying cylinders. These lines are placed one above the other, over which cylinders the web is guided to run in a meandering manner. In the cylinder groups of the prior-art, multi-cylinder dryers, both the single-wire draw and twin-wire draw are used. As a rule, the single-wire draw in which both the drying wire and the web supported by the wire run meandering manner from the lower line of cylinders to the upper line and vice versa, is used in an initial part of drying section, because at that point the web is of higher moisture and lower strength, and by means of the single-wire draw, a closed draw without open transfers can be obtained.

Twin-wire groups in which the web has free draws unsupported by the wires between the lines of cylinders are, as a rule, used in the final end of the drying section, where the web is sufficiently strong so such that the free draws of consequent web and the fluttering occurring therein do not cause excessive breakage of the web. In the case of the single-wire draw on the cylinders, most commonly the lower cylinders which are placed inside the wire loop, the drying wire is in direct contact with the cylinder faces, and the web is thereby outside the wire, which results in lowering of the drying capacity. This is the reason why, when a single-wire draw is employed, several cylinders must be added to an the multi-cylinder dryer.

The present invention relates to improvement over such prior-art dryers in which a particular single-wire draw is used, wherein the cylinders in each drying-wire group are placed outside their respective wire loop so that on all the drying cylinders in a wire group, the web is pressed between the face of the drying cylinder and the drying wire or felt. With respect to these prior art dryers, reference is made to U.S. Pat. Nos. 796,601; 4,483,083; 4,677,762; and to the Valmet Finnish Patent No. 53,333 corresponding to U.S. Pat. No. 3,868,780.

The object of the present invention is to achieve further improvement or development over the drying section described in the Valmet Finnish Patent No. 53,333 corresponding to U.S. Pat. No. 3,868,780, in particular the FIG. 9 of that patent, so that the advantages obtained by means of the prior-art dryer are retained, but the drawbacks occurring therein are avoided. In the drying section illustrated in FIG. 9 of Finnish Patent No. 53,333, the cylinders are placed in vertical, single-wire groups situated one after the other, between which the web has unsupported and free draws. In the present-day, high-speed paper machines, the free draws cause breaks, and therein the drying tension tends to be relaxed, causing detrimental shrinkage of the paper web.

For example, in U.S. Pat. No. 4,677,762, long dry suction boxes are used at the wire transfers between vertical cylinder stacks provided with single-wire draw, by means of which attempts are made to keep the web in contact with the face of the drying wire so that it should not become detached from the wire, and that the drying tensions should not be relaxed into stretching. In order to prevent stretching of the web, it is necessary to use relatively extensive levels of negative pressure, which has the consequence that the faces of the drying wire rub against the suction boxes, which causes, in particular, detrimental wear of the wires.

SUMMARY OF THE INVENTION

Accordingly, it is an object of the present invention to avoid the drawbacks presented above, and to provide a multi-cylinder dryer similar to those described above in which a closed draw supported by means of negative pressure for the web is obtained, wherein it is intended that the web is, at all times, supported by the wire and most of the time supported by the wire and a cylinder phase and, when the web is outside the cylinders, it is substantially at all times supported by a suction face, as well as being so supported along transfers between lines of cylinders.

Another object of the present invention is to provide a multi-cylinder dryer whose length is substantially shorter than in the case of normal dryers which comprise two lines of cylinders situated one above the other, whereby it is possible to lower substantially the cost of construction of the paper machine hall and the related supplementary costs.

It is an additional object of the present invention to provide a drying section in which removal of broke is relatively free of difficulties.

It is a further object of the present invention to provide a multi-cylinder dryer in which, in subsequent wire groups, the web face situated in contact with the drying cylinders is reversed or exchanged, whereby the drying process is intensified and the web quality is improved.

It is yet another object of the present invention to provide a multi-cylinder dryer in which threading of a leading end of the web is facilitated so that, in the drying section, threading ropes with control devices thereof are not necessarily required at all.

These and other objects are attained by the present invention which is directed to a multi-cylinder dryer in a paper machine, comprising several drying groups situated one after the other, in which drying cylinders are placed one above another with a web being passed from one drying cylinder in one group onto a drying cylinder of a following group by means of a single-wire draw, so that drying cylinders in single-wire draw groups are situated outside loops of respective drying wires when the web is passed from one drying cylinder onto a next drying cylinder over suction rolls while being supported by a respective wire, and the web entering into direct contact with heated faces of the respective drying cylinders in the single wire groups while being pressed by the respective drying wire over a considerably large sector.

The web is passed as a supported draw from one single-wire group of drying cylinders to a subsequent single-wire group with at least two transfer-suction rolls, arranged such that, in a direction of web travel, a first transfer-suction roll is situated inside the loop of the respective drying wire of the preceding single-wire draw group, a final transfer-suction roll is situated proximate to said first transfer-suction roll and inside the loop of the respective drying wire of the subsequent single-wire draw group proximate to a first drying cylinder in said subsequent single-wire draw group, and transfer of the web from one wire group to a subsequent wire group takes place substantially at all times with support by a drying wire so that, substantially over an entire distance of transfer, the web is subjected to a difference in pressure that maintains the web in contact with the respective drying wire.

The drying cylinders are preferably arranged in vertical stacks, while the sector over which the web is in direct contact with the heated face of a respective drying cylinder is most appropriately larger than about 180°. Preferably, two and only two transfer-suction rolls are provided between respective drying groups, while the web is subjected most appropriately to a negative pressure effective from a drying-wire side.

Therefore, with a view to achieving the objects stated above, and those which will become apparent below, the present invention is principally characterized by a web being passed as a supported draw from one single-wire group to a subsequent single-wire group by using at least two, most appropriately only two, transfer-suction rolls, in which a first transfer-suction roll is situated inside a loop of a drying wire of the preceding single-wire draw group, and in which a final transfer-suction roll is situated proximately to said first suction roll of said preceding wire group, and also inside a loop of the drying wire of the subsequent single-wire draw group proximate to a first drying cylinder in the subsequent single-wire draw group, as seen in a direction of running of the web, and furthermore by transfer of the web from one wire group to a subsequent wire group taking place, substantially at all times, supported by a drying wire such that, substantially over an entire distance of transfer, the web is subjected to a difference in pressure that maintains the web in contact with the drying wire, most appropriately a negative pressure effective from a drying-wire side.

In the multi-cylinder dryer in accordance with the present invention, the web can be better supported than in corresponding prior-art dryers, since the transfer of the web between the cylinder stacks takes place by means of two transfer-suction rolls of relatively large diameter. In such a case, the draws of the web and the wire that are free, with no support by suction effect, can be made so short that the drying tensions of the web do not have time to become relaxed to a detrimental extent whereby the web would be extended or stretched. In practice, the length of these draws which are not supported by a suction face but which are supported by the wire, is of an order of only about 500 mm.

When the present invention is applied, one suction roll is also used between the cylinders situated one above the other or side by side in the same stack. In such a case, it is possible to use various structures comprising suction rolls known in the prior art, such as normal suction rolls provided with suction chambers and perforated mantles, or suction and blow-box constructions similar to those described, e.g., in the Valmet Finnish Patent Applications Nos. 881106; 881105; 874191; 873812; and 862413, as well as other suction roll constructions.

The two transfer-suction rolls used in the transfers between the wire groups in accordance with the present invention may have suction zones of different levels of negative pressure. These transfer-suction rolls are most appropriately rolls of equal diameters, however it is also possible to use rolls of different sizes.

In these transfer-suction rolls, and also in the suction rolls between adjoining cylinders, it is possible to use particular suction zones proximate to one of the ends thereof, by means of which zones threading of the web is carried out even without a system of threading ropes. With respect to details of these constructions, reference is made to the Valmet Finnish Patent Application No. 862413.

In a preferred embodiment of the present invention, the drying cylinders in different wire groups are situated in vertical stacks placed side by side, so that in each stack there are, as a rule, three or more drying cylinders placed one above the other, and in special cases two drying cylinders placed one above the other. In this embodiment, when the suction-supported closed draw of the drying wires and of the web supported by the drying wire in accordance with the present invention is used between cylinder stacks and wire groups, the length of the drying section can be reduced further, even to half the length otherwise necessary.

By using a drying section in accordance with the invention, the side of the web to be dried that is situated against the drying cylinders can be reversed or exchanged in subsequent wire groups, whereby the web quality is improved. A web transfer in accordance with the present invention from one wire group to the other can also be employed in dryers in which the cylinders in a wire group are situated in horizontal lines or stacks. With respect to these types of cylinder geometries, reference is made, by way of example, to FIGS. 1 and 6 in the Valmet Finnish Patent No. 53,333.

BRIEF DESCRIPTION OF THE DRAWINGS

The present invention will be described in greater detail below, with reference to certain exemplary embodiments thereof illustrated in the accompanying figures, and to which, however, the present invention is by no means intended to be strictly confined. In the drawings, FIG. 1 in a schematic side view of a part of a dryer in accordance with the present invention.

DESCRIPTION OF THE PREFERRED EMBODIMENTS

Figure 1:
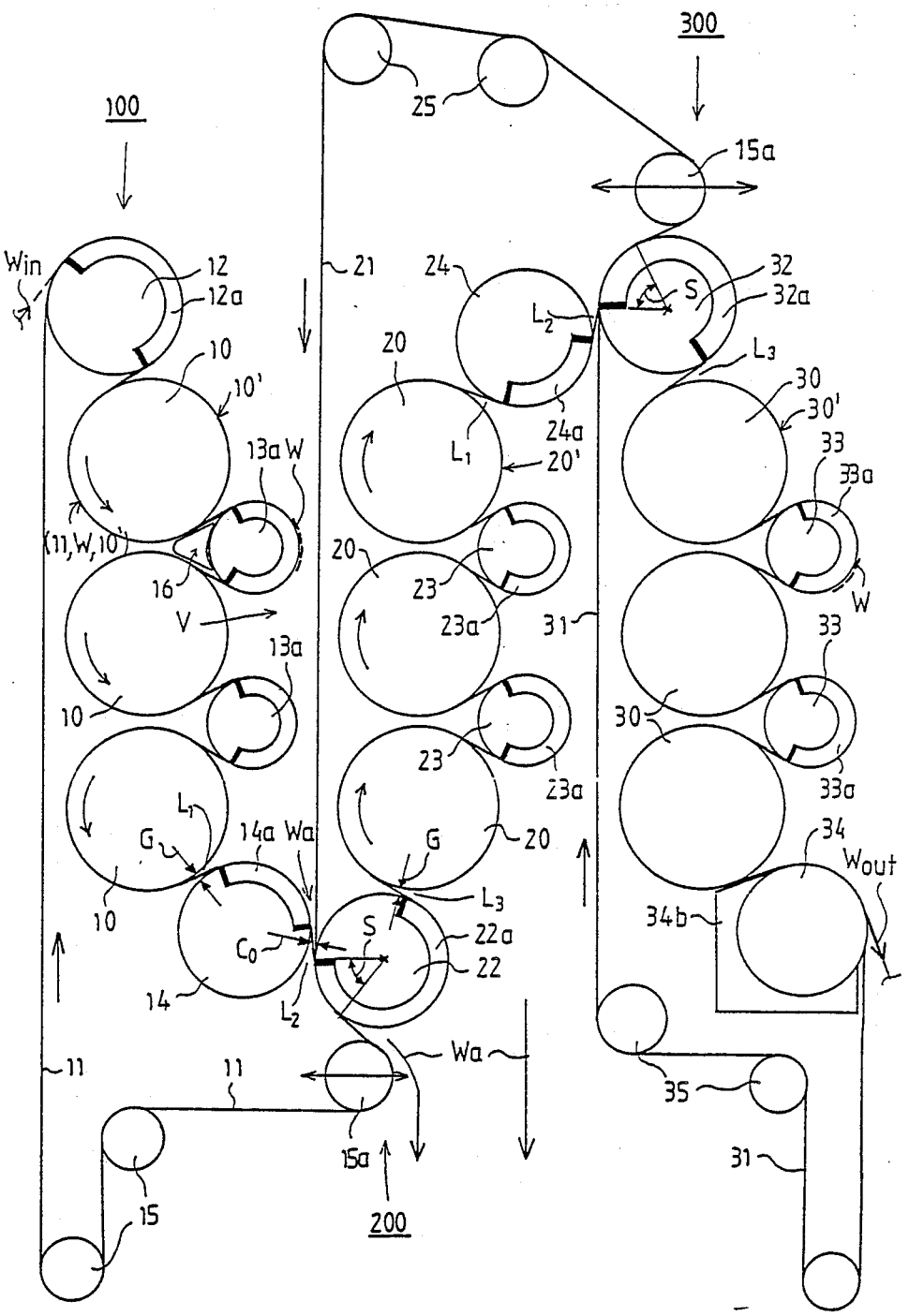

FIG. 1 illustrates three subsequent wire groups 100, 200 and 300 in a drying section, comprising vertical stacks constituted by three steam-heated drying cylinders 10, 20, 30 situated one above the other, as well as drying wires 11, 21 and 31 in each wire group. The inlet of the web W in the first group 100 is denoted with the reference character $W_{in}$, and its outlet out of the last group 300 is denoted by the reference character $W_{out}$. Before the first group 100, there may be similar single-wire groups or other groups of drying cylinders, and after the last group 300 there may be similar or different wire groups, as described more closely in conjunction with FIG. 2.

As illustrated in FIG. 1, the wire groups 100, 200 and 300 are provided with single-wire draw, so that the drying cylinders 10, 20, 30 are situated outside the loops of the respective wires 11, 21, 31. The web w to be dried is passed over the cylinders 10, 20, 30 so that the drying wire 11, 21, 31 presses the web W directly into contact with the hot cylinder faces 10', 20', 30'. Between the cylinders 10, 20, 30 in the different subsequent stacks, there are suction rolls 13, 23, 33 which are provided with suction zones **13*a*, 23*a*, 33*a* which keep the web W efficiently on the face of the drying wire 11, 21, 31 while the web W is at a side of the respective outside surfaces thereof. The suction rolls 13*a*, 23*a*, 33*a* and the drying cylinders 10, 20, 30 are placed in such a manner that the web W has a maximally large covering sector on the drying cylinders 10, 20, 30. This covering sector is preferably always larger than about 180°, and, as a rule, about 200° to 280°. In FIG. 1, reference numerals 15, 25 and 35** denote guide rolls.

In FIG. 1, inside each wire loop 11, 21, 31 both at the inlet side and at the outlet side of the web W, there are transfer-suction rolls, each having a diameter sufficiently large such that the space between the cylinder stacks becomes bridged-over. Thus, inside the wire 11 of the first wire loop 100, there are transfer-suction rolls 12 and 14 provided with suction zones **12*a* and 14*a*. Inside the loop of the wire 21 of the second wire group 200, at the inlet side thereof, there is a transfer-suction roll 22 provided with a suction zone 22*a*, while at the outlet side a transfer-suction roll 24 provided with a suction zone 24*a*** is situated.

In a corresponding manner, inside the loop of the wire 31 of the third wire group 300, at an inlet side thereof, there is a transfer-suction roll 32 provided with a suction zone **32*a*, and at the outlet side thereof there is a transfer-suction roll 34 provided with a suction chamber 34*b*. At the transfer point between the wire groups, the transfer-suction rolls are arranged proximately to one another, and at short gaps security G from adjoining drying cylinders, so that the web W has as short a series or draws as possible $L_1$, $L_2$, and $L_3$ which are not supported by suction faces. Between adjoining transfer-suction rolls, there is a small gap $C_0$ or a transfer nip. On a small sector s, the wires are situated one above the other on the suction rolls 22, 32 and thereat, by the effect of the negative pressure in the suction zones 22*a*, 32*a*, the web is transferred from the wire respective wires 11, 21 to the respective subsequent wire group 21, 31**.

The magnitude of this covering sector s is advantageously arranged to be adjustable by regulating the position of a lead roll **15*a***. In connection with the threading, it is preferably to use a reasonably large covering sector s. However, after the run of the web has become stabilized, it is advantageous to reduce the sector s to a very small angle, even down to a line contact, or even to use a very short free draw of the web instead of a covering sector s.

When the lead rolls **15*a*** are arranged to be adjustable, it is also possible by means of this adjustment to accomplish the advantageous properties of a free gap being opened between subsequent transfer-suction rolls, through which gap the paper web $W_a$ passing to broke can be favorably removed.

As illustrated in FIG. 1, the drying wires 11, 21, 31 run in gaps V between adjoining cylinder stacks to pairs of transfer-suction rolls 14, 22; 24, 32 in subsequent wire groups in opposite directions. In the event of breaks, the paper web passing to broke can be removed through the gaps V in the directions indicated by the arrows $W_a$, in the open gaps directly into the pulper or broke conveyors situated underneath, and in those gaps in which the pairs of transfer suction rolls 14, 22 are situated underneath, through a gap between the transfer-suction rolls since the outer wire 11 is resilient.

Figure 2:
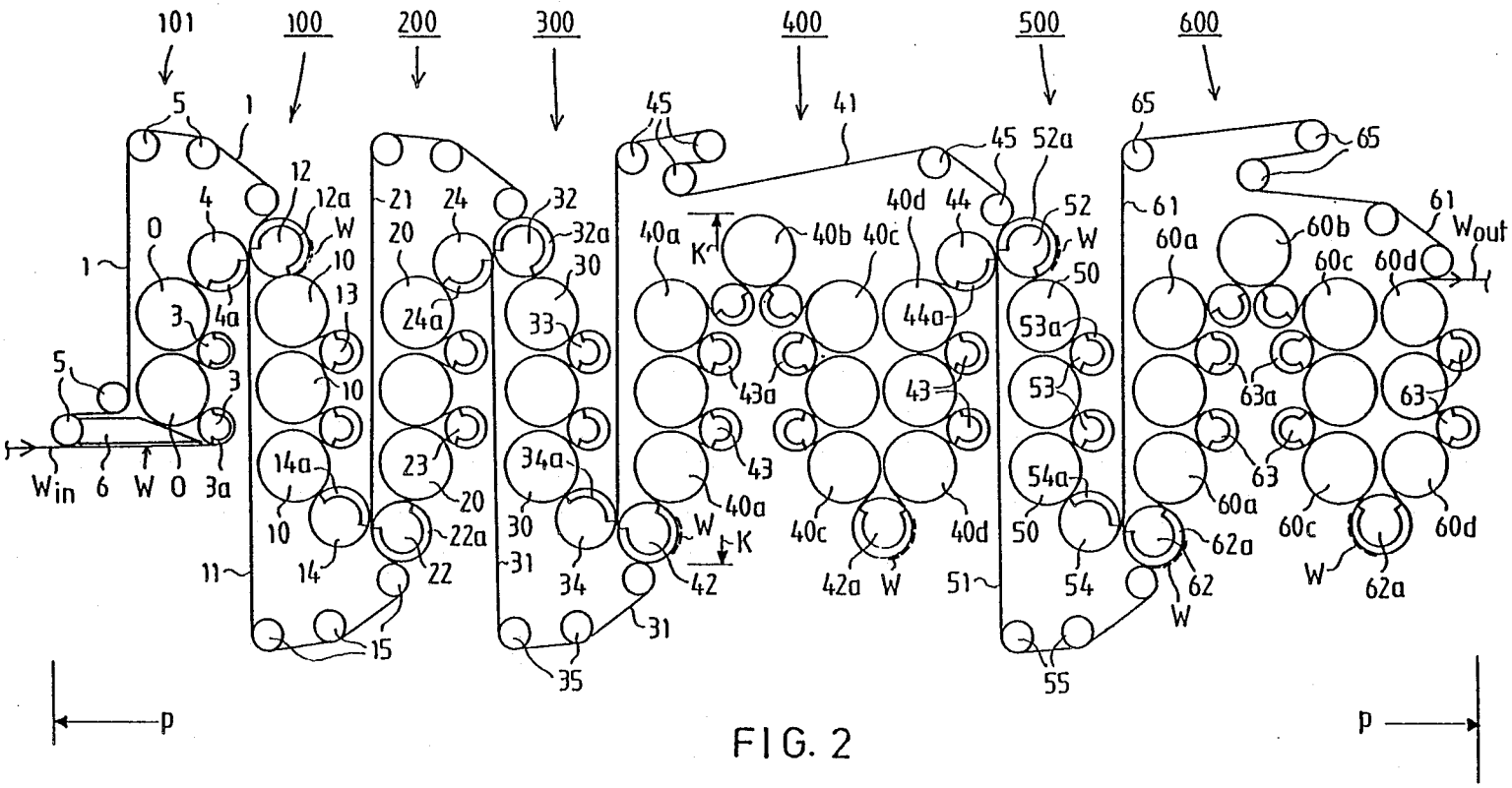
FIG. 2 is a schematic side view of the overall structure of a preferred embodiment of a dryer in accordance with the present invention.

FIG. 2 illustrates overall geometry of a drying section in accordance with the present invention. The paper web W is passed from the press section (not illustrated) of the paper machine onto a first wire 1 which is guided by guide rolls 5. The pre-wire group 101 is lower than normal and comprises only two drying cylinders 0, one above the other. The web $W_{in}$ is passed onto the drying wire 1 guided by the guide roll 5, to which wire 1 the web is caused to adhere by means of suction of a suction box 6, upon which the web W is passed across a suction zone **3*a* of a suction roll 3 and onto the first drying cylinder 0 which is situated outside the wire loop. Hereupon, the web W is passed around the suction zone 3*a* of the suction roll 3 onto a second drying cylinder 0 and from there further onto a suction zone 4*a* of a transfer-suction roll 4, where the web is delivered onto a second wire 11 on a suction zone 12*a* of a transfer-suction roll 12, after which the construction is similar to the arrangement described in FIG. 1, until a third wire group 300** proper.

After the third wire group 300, a particular fourth wire 400 follows which has a long wire loop 41 guided by guide rolls 45. The wire group 400 comprises four cylinder stacks, of which there are three drying cylinders **40*a* in the first cylinder stack, while there is only one cylinder 40*b* in the second "stack" in which area the run of the wire 41 and of the web W are turned downwardly while running over cylinders 40*c* in the third stack. The third and fourth stacks have three cylinders 40*c* and 40*d* each, and there is a suction roll 42*a* between the stacks. In other respects, the construction is similar to that described above, and comprises a first transfer-suction roll 42 and the transfer-suction rolls 43 placed between the cylinders and provided with suction zones 43*a***.

After the wide wire group 400, the web W, guided by the suction zone **44*a* of its final transfer-suction roll 44, is transferred onto a suction zone 52*a* of a first transfer-suction roll 52 of a fifth wire group 500. The fifth wire group 500 comprises three drying cylinders 50 situated one above the other, and between the cylinders, suctions rolls 53** which are provided with suction zones.

After the fifth wire group 500, the web W is transferred onto a suction zone of a suction roll 54, over a suction zone **62*a* of a transfer-suction roll 62 of a sixth wire group 600 and onto a first drying cylinder 60*a* in a sixth group 600, the number of these drying cylinders being three, placed in a stack one above the other. After this, in the sixth wire group 600, there is a single drying cylinder 60*b*, in which area the runs of the wire 61 and of the web turn downwardly onto a cylinder stack which comprises three cylinders 60*c* situated one above the other. After the latter stack, the web W is transferred over a suction roll 62*a* onto a final cylinder stack 60*d*** and from there, in a direction of the arrow $W_{out}$, further to a reel-up machine calender or equivalent (not illustrated).

Referring to FIG. 1, it should be stated that the diameters of the transfer-suction rolls 14, 22, 24, 32 are dimensioned sufficiently large so that a space between the cylinder stacks can be bridged-over so that the gaps $L_1$, $L_2$, $L_3$ of the web W unsupported by a suction face, can be minimized. When the diameters of the drying cylinders are, as a rule, within a range of about 1500 to 3000 mm, diameters of the transfer-suction rolls are within a range of about 500 to 2500 mm, at which the upper and lower limits of these ranges substantially correspond to one another. The shortest gap $C_0$ between the transfer-suction rolls is, as a rule, within a range of about 0 to 500 mm, most appropriately within a range of about 50 to 100 mm. This means that between the transfer-suction rolls 14/22 and 24/32, there may also be a transfer nip, which is, however, as a rule not the most advantageous embodiment of the invention, e.g. in view of removal of broke.

The shortest distances G of the transfer-suction rolls 14, 22; 24,32 from the adjoining drying cylinders 10, 20; 20, 30 are, as a rule, with a range of about 0 to 800 mm, most appropriately within a range of about 60 to 200 mm. As a rule, it is preferred to leave a certain security gap G of an order, e.g. of about 100 mm, between the transfer-suction rolls and the adjoining drying cylinders.

As typical dimensioning of the drying section in accordance with the present invention, the following example is given:

length P of a drying section of a type illustrated in FIG. 2 is P=34 m. and height K=9 m. The diameters of the drying cylinders are 1800 mm, the diameters of the transfer-suction rolls are 1500 mm, and the diameters of the suction rolls 13...63 between the drying cylinders are 1000 mm.

The diameters of the pairs of transfer-suction rolls 14/20; 24, 32 do not have to be equal as compared with one another, and the rolls in these pairs have most appropriately a certain difference an height, as is apparent from FIGS. 1 and 2.

It is advantageous to use, e.g. three transfer-suction rolls instead of two suction rolls in some special applications which are, as a rule, not advantageous but such a construction generally confers no unexpected advantages. Moreover, it is possible to use various devices such as the blow devices described in the earlier Valmet patents between sufficient transfer-suction rolls, by means of which the support contact between the drying wire and the web is maintained in the transfer areas $L_1$, $L_2$, $L_3$.

The present invention may vary within the scope of the inventive concepts set forth above and differ from what has been described above which has been presented for the sake of example only. Therefore, the preceding description of the present invention is merely exemplary, and is not intended to limit the scope thereof in any way.

What is claimed is:

1. A multi-cylinder dryer for a paper or paperboard making machine through which a web passes, said multi-cylinder dryer comprising:

a plurality of drying groups, each of said drying groups comprising:

at least two drying cylinders which are situated over each other such that a line between their respective centers is no more than slightly inclined relative to the vertical plane but which cylinders are not in direct contact with each other;

at least one suction roll;

a drying wire forming a loop and so positioned that said drying cylinders are outside the loop of said drying wire; said drying wire carrying said web from one drying cylinder to an adjacent drying cylinder by passing said web over said suction roll and causing said web to be pressed against a large angular portion of a heated surface of said one drying cylinder;

and said multi-cylinder dryer comprising a first transfer-suction roll and a second transfer-suction roll over which said web is passed from a first drying group to a second adjacent drying group and wherein said first transfer-suction roll is situated within the loop of a drying wire of said first drying group and said second transfer-suction roll is situated in proximity to said first transfer-suction roll and within the loop of another drying wire of said second drying group and said web is thus passed between said first and said second drying groups so as to be essentially continuously supported by a drying wire;

said second transfer-suction roll being situated in proximity to a first drying cylinder contacted by said web in said second drying group;

and said multi-cylinder dryer comprising means for causing a pressure differential impelling said web against a drying wire substantially throughout the passing of said web between said first drying group and said second drying group;

and said multi-cylinder dryer comprising at least two additional drying groups and said multi-cylinder dryer comprising a first transfer-suction roll located in proximity to a last drying cylinder of a first adjacent one of said at least two additional groups through which said web passes before reaching said first transfer-suction roll and said multi-cylinder dryer comprising a second transfer-suction roll located in proximity to a first drying cylinder of a second adjacent one of said at least two additional drying groups through which said web passes after reaching said second transfer-suction roll, and wherein a drying wire of said first adjacent drying group contacts said first transfer-suction roll, and wherein a suction zone of said second transfer-suction roll facilitates transfer of said web from said first adjacent drying group to said second adjacent drying group.

2. The multi-cylinder dryer of claim 1, wherein said large angular sector is at least 180 degrees.

3. The multi-cylinder dryer of claim 1, wherein the distance between said first transfer-suction roll and said second transfer-suction roll is smaller than the diameter of either said first transfer-suction roll or said second transfer-suction roll.

4. The multi-cylinder dryer of claim 1, wherein the area of contact of said web and said drying wire of said first drying group on said first transfer-suction roll is smaller than the area of contact of said web and said drying wire of said second drying group on said second transfer-suction roll.

5. The multi-cylinder dryer of claim 3, wherein the area of contact of said web and said drying wire of said first drying group on said first transfer-suction roll is smaller than the area of contact of said web and said drying wire of said second drying group on said second transfer-suction roll.

* * * * *